US009359582B2

(12) United States Patent
Kaminski et al.

(10) Patent No.: US 9,359,582 B2
(45) **Date of Patent: *Jun. 7, 2016**

(54) SUPERABSORBING GEL FOR ACTINIDE, LANTHANIDE, AND FISSION PRODUCT DECONTAMINATION

(71) Applicant: UCHICAGO ARGONNE, LLC, Chicago, IL (US)

(72) Inventors: Michael D. Kaminski, Lockport, IL (US); Carol J. Mertz, Downers Grove, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/380,482

(22) PCT Filed: Feb. 28, 2013

(86) PCT No.: PCT/US2013/028335

§ 371 (c)(1),
(2) Date: Aug. 22, 2014

(87) PCT Pub. No.: WO2013/176721

PCT Pub. Date: Nov. 28, 2013

(65) Prior Publication Data

US 2015/0038387 A1 Feb. 5, 2015

Related U.S. Application Data

(63) Continuation-in-part of application No. 13/409,835, filed on Mar. 1, 2012, now Pat. No. 8,658,580.

(51) Int. Cl.

| | |
|---|---|
| ***C11D 3/37*** | (2006.01) |
| ***C11D 1/00*** | (2006.01) |
| ***G21F 9/00*** | (2006.01) |

(52) U.S. Cl.
CPC ..... *C11D 1/008* (2013.01); *G21F 9/002* (2013.01)

(58) Field of Classification Search
CPC ..... C11D 3/37; G21F 9/002
USPC ..... 510/110; 588/7, 13
See application file for complete search history.

(56) References Cited

U.S. PATENT DOCUMENTS

| | | |
|---|---|---|
| 3,258,429 A | 6/1966 | Weed |
| 5,405,509 A | 4/1995 | Lomasney et al. |

(Continued)

FOREIGN PATENT DOCUMENTS

| | | |
|---|---|---|
| GB | 2112764 A | 7/1983 |
| WO | 2011056288 A1 | 5/2011 |

*Primary Examiner* — John Hardee
(74) *Attorney, Agent, or Firm* — Olson & Cepuritis, Ltd.

(57) ABSTRACT

The present invention provides an aqueous gel composition for removing actinide ions, lanthanide ions, fission product ions, or a combination thereof from a porous surface contaminated therewith. The composition comprises a polymer mixture comprising a gel forming cross-linked polymer and a linear polymer. The linear polymer is present at a concentration that is less than the concentration of the cross-linked polymer. The polymer mixture is at least about 95% hydrated with an aqueous solution comprising about 0.1 to about 3 percent by weight (wt %) of a multi-dentate organic acid chelating agent, and about 0.02 to about 0.6 molar (M) carbonate salt, to form a gel. When applied to a porous surface contaminated with actinide ions, lanthanide ions, and/or other fission product ions, the aqueous gel absorbs contaminating ions from the surface.

20 Claims, 3 Drawing Sheets

(56) References Cited

U.S. PATENT DOCUMENTS

| | | | |
|---|---|---|---|
| 5,599,666 | A | 2/1997 | Schumm et al. |
| 5,929,198 | A | 7/1999 | Tang |
| 6,504,003 | B1 | 1/2003 | Trout et al. |
| 7,166,758 | B2 | 1/2007 | Nunez et al. |
| 7,169,370 | B2 | 1/2007 | Mesmin et al. |
| 7,737,320 | B1 | 6/2010 | Kaminski et al. |
| 7,790,134 | B1 | 9/2010 | Rai et al. |
| 8,658,580 | B2 * | 2/2014 | Kaminski et al. ..... C11D 3/37 510/110 |
| 2005/0230267 | A1 | 10/2005 | Veatch et al. |
| 2006/0002879 | A1 | 1/2006 | Chen et al. |
| 2012/0009124 | A1 | 1/2012 | Port et al. |

* cited by examiner

SUPERABSORBING GEL FOR ACTINIDE, LANTHANIDE, AND FISSION PRODUCT DECONTAMINATION

CROSS-REFERENCE TO RELATED APPLICATIONS

This application is a continuation-in-part of U.S. application Ser. No. 13/409,835, filed on Mar. 1, 2012now U.S. Pat. No. 8,658,580, which is incorporated herein by reference in its entirety.

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

This invention relates to compositions and methods for decontamination of radionuclides from porous surfaces. More particularly, this invention relates to compositions and methods for decontaminating actinides, lanthanides, and/or fission products from porous surfaces.

BACKGROUND OF THE INVENTION

Argonne National Laboratory has developed a superabsorbing hydrogel-based process for the decontamination of cesium from concrete and other porous building materials (see, e.g., U.S. Pat. No. 7,737,320, which is incorporated herein by reference in its entirety). This process uses commercially available spray technology, commercially available biocompatible polymers, common chemical reagents, and commercial wet-vacuum technology. It works by spraying a water-based chemical on the concrete surface, followed by spraying the surface with a superabsorbing gel. The gel retains its consistency at relatively high temperatures and humidity for many hours. The gel is removed by wet-vacuum technology, and the recovered gel material can be dehydrated to significantly reduce the waste volume requiring disposal. While the gel formulation is suitable for cesium decontamination, it is not optimum for decontamination of actinides (e.g., americium), lanthanides, or fission products from porous surfaces, particularly concrete, brick, tile, marble, granite, and asphalt.

Decontamination of radionuclide ions (e.g., actinides, lanthanides, and fission products) from porous surfaces (e.g., concrete, brick, tile, marble, granite, asphalt, and the like) is generally very difficult because the porosity of the surface allows for penetration of the radionuclide ions below the surface of the material. In fact, there are very few non-destructive options for removal of actinide and other fission product ion contaminants from concrete, brick, tile, marble, granite, asphalt, and other porous surfaces. Most known decontamination protocols for actinide and other fission product ions are designed for decontamination of non-porous surfaces, such as metals. These protocols generally involve the use of harsh acids to remove the oxide scales that host the radionuclide ions. Acidic materials are destructive to many porous construction materials, such as concrete, brick, marble, and brick. In addition, strongly acidic materials are toxic, requiring deployment only in closed or contained environments.

There is an ongoing need for new, more efficient, non-destructive decontamination compositions and methods for removing actinide and lanthanide ions from porous surfaces. The present invention addresses this ongoing need.

SUMMARY OF THE INVENTION

The present invention provides aqueous gel compositions and methods for decontaminating porous surfaces contaminated with actinide, lanthanide, and/or fission product ions. An aqueous gel composition described herein includes a polymer mixture comprising a gel-forming cross-linked anionic or nonionic polymer and a linear anionic or nonionic polymer. The linear polymer is present at a concentration that is less than the concentration of the cross-linked polymer. The polymers are at least about 95% hydrated (preferably fully hydrate) with an aqueous solution to form a gel. The aqueous solution comprises a molar (M) concentration of about 0.01 to about 0.5 M of a multi-dentate organic acid chelating agent (also referred to herein as a "chelator"), and at least about 0.02 M carbonate salt, up to about 1 M carbonate salt (preferably about 0.25 M to about 0.5 M carbonate). Optionally, the aqueous gel composition further includes at least one particulate sequestering agent dispersed in the aqueous gel. The sequestering agent preferably is at least one material selected from the group consisting of a clay, a zeolite, monosodium titanate (MST), crystalline silicotitanate (CST), and cellulose acetate (CA).

When applied to a porous surface contaminated with actinide, lanthanide, and/or fission product ions, the aqueous gel absorbs contaminating ions from the surface. The particulate sequestering agent, when present, can act as a sink or trap for the contaminant ions absorbed from the surface.

In some embodiments the cross-linked polymer and the linear polymer are present in a respective weight ratio of about 99 to 1. The cross-linked polymer and/or the linear polymer can be an anionic polymer or a nonionic polymer. In some preferred embodiments, the polymers comprise a copolymer of acrylamide and acrylic acid (e.g., a copolymer of acrylamide and acrylic acid in a relative monomer molar ratio of about 70 to 30).

The chelator used in the compositions and methods described herein can be any material capable of chelating actinide ions, lanthanide ions, fission product ions (e.g., americium, plutonium, uranium, curium, neptunium, strontium, radium, a lanthanide, and other fission product ions having a positive charge of 2 or greater), or a combination thereof. In a preferred embodiment, the chelator comprises at least one material selected from the group consisting of 1-hydroxyethane-1,1-bisphosphonic acid (HEDPA) or another related diphosphonic acid or a salt thereof, and ethylenediaminetetraacetic acid (EDTA) or another related polyaminocarboxylic acid compound or a salt thereof. Preferably, the aqueous gel composition comprises about 0.01 M up to about 0.5 M of HEDPA, EDTA, or a salt (e.g., sodium salt) thereof. In some embodiments, the composition comprises about 0.02 to 0.03 M HEDPA.

One preferred aqueous gel composition comprises about 2 to about 6 wt % of the polymer mixture, at least about 95% hydrated with an aqueous solution comprising about 0.01 to 0.5 M concentration of the multi-dentate organic acid chelating agent, and about 0.1 to about 1 M carbonate salt (e.g., in some embodiments up to about 0.4 or 0.5 M or 0.6 M carbonate); wherein the multi-dentate organic acid chelating agent comprises at least one material selected from the group consisting of 1-hydroxyethane-1,1-bisphosphonic acid (HEDPA), ethylenediaminetetraacetic acid (EDTA), and a salt thereof; and each of the cross-linked polymer and the linear polymer comprises a copolymer of acrylamide and acrylic acid in a relative monomer molar ratio of about 70 to 30. Preferably, the polymer mixture further comprises about 5 to about 15 wt % (more preferably about 10 wt %) of at least one particulate sequestering agent based on the combined dry weight of the polymers and the sequestering agent, the sequestering agent preferably being at least one material selected from the group consisting of a clay, a zeolite, MST, CST, and CA.

The present invention also provides a method of decontaminating a porous surface contaminated with actinide ions, lanthanide ions, fission product ions, or a combination thereof (e.g., americium, plutonium, uranium, curium, neptunium, strontium, radium, a lanthanide, cesium, and other fission product cations, e.g., cations having a charge, e.g., of 1, 2 or greater). The method comprises contacting a surface of the substrate with an aqueous gel composition of the invention for a period of time sufficient to absorb contaminating actinide, lanthanide, and/or fission product ions from the porous surface into the gel, and subsequently removing the gel and absorbed ions from the surface.

The following non-limiting embodiments are encompassed by the compositions and methods described herein.

Embodiment 1 comprises an aqueous gel composition for removing actinide ions, lanthanide ions, fission product ions, or a combination thereof from a porous surface contaminated therewith. The composition comprises a polymer mixture comprising a gel-forming cross-linked polymer and a linear polymer; wherein the linear polymer is present at a concentration that is less than the concentration of the cross-linked polymer; the polymers are anionic, nonionic or a combination thereof, and the polymer mixture is at least about 95% hydrated with an aqueous solution to form a gel; the aqueous solution comprises about 0.01 M to about 0.5 M of a multi-dentate organic acid chelating agent, and about 0.02 to about 1 M carbonate salt; and the polymer mixture optionally includes at least one particulate sequestering agent. The sequestering agent becomes dispersed within the aqueous gel when the polymer mixture is hydrated.

Embodiment 2 comprises the aqueous gel composition of embodiment 1 wherein the carbonate salt is present at a concentration in the range of about 0.25 M to 0.5 M.

Embodiment 3 comprises the aqueous gel composition of any one of embodiments 1 to 2 wherein the cross-linked polymer and the linear polymer are present in a respective weight ratio of about 99 to 1.

Embodiment 4 comprises the aqueous gel composition of any one of embodiments 1 to 3 wherein the polymers are present in the gel at a combined concentration in the range of about 2 to about 6 wt %.

Embodiment 5 comprises the aqueous gel composition of any one of embodiments 1 to 4 wherein the cross-linked polymer comprises a copolymer of acrylamide and acrylic acid.

Embodiment 6 comprises the aqueous gel composition of any one of embodiments 1 to 5 wherein the linear polymer comprises a copolymer of acrylamide and acrylic acid.

Embodiment 7 comprises the aqueous gel composition of any one of embodiments 1 to 6 wherein each of the cross-linked polymer and the linear polymer comprises a copolymer of acrylamide and acrylic acid in a relative monomer molar ratio of about 70 to 30.

Embodiment 8 comprises the aqueous gel composition of any one of embodiments 1 to 7 wherein the multi-dentate organic acid chelating agent comprises at least one material selected from the group consisting of 1-hydroxyethane-1,1-bisphosphonic acid (HEDPA) and ethylenediaminetetraacetic acid (EDTA).

Embodiment 9 comprises the aqueous gel composition of embodiment 8 wherein the HEDPA is present at a concentration of about 0.02 to 0.03 M.

Embodiment 10 comprises the aqueous gel composition of any one of embodiments 1 to 9 wherein the carbonate salt comprises an alkali metal carbonate, an alkali metal bicarbonate, ammonium carbonate, ammonium bicarbonate, or a combination of two or more thereof.

Embodiment 11 comprises the aqueous gel composition of any one of embodiments 1 to 10 wherein the polymer mixture further comprises at least one particulate sequestering agent.

Embodiment 12 comprises the aqueous gel composition of embodiment 11 wherein the sequestering agent is selected from the group consisting of a clay, a zeolite, a layered metal sulfide, crystalline silicotitanate (CST), monosodium titanate (MST), cellulose acetate (CA), and a combination of two or more thereof.

Embodiment 13 comprises the aqueous gel composition of embodiment 12 wherein the at least one particulate sequestering agent is present in the polymer mixture at a concentration in the range of about 5 to about 15 wt % based on the combined dry weight of the polymers and the sequestering agent.

Embodiment 14 comprises the aqueous gel composition of embodiment 1 wherein the composition comprises about 2 to about 6 percent by weight (wt %) of the polymer mixture comprising the gel forming cross-linked anionic polymer salt and the linear anionic polymer salt; wherein the linear anionic polymer salt is present at a concentration that is less than the concentration of the cross-linked anionic polymer salt; each of the cross-linked anionic polymer salt and the linear anionic polymer salt comprises a copolymer of acrylamide and acrylic acid in a relative monomer molar ratio of about 70 to 30; the cross-linked anionic polymer salt is at least about 95% hydrated with an aqueous solution to form a gel; the aqueous solution comprises about 0.01 M to about 0.25 M of a multi-dentate organic acid chelating agent, and about 0.25 to about 0.5 M carbonate salt; and the multi-dentate organic acid chelating agent comprises at least one material selected from the group consisting of 1-hydroxyethane-1,1-bisphosphonic acid (HEDPA), ethylenediaminetetraacetic acid (EDTA), and a salt thereof.

Embodiment 15 comprises the aqueous gel composition of embodiment 14 wherein the polymer mixture further comprises about 5 to about 15 wt % of at least one particulate sequestering agent based on the combined dry weight of the polymers and the sequestering agent Embodiment 16 comprises the aqueous gel composition of embodiment 15 wherein the sequestering agent is selected from the group consisting of a clay, a zeolite, a layered metal sulfide, crystalline silicotitanate (CST), monosodium titanate (MST), cellulose acetate (CA), and a combination of two or more thereof.

Embodiment 17 comprises a method of decontaminating a porous surface contaminated with actinide ions, lanthanide ions, fission product ions, or a combination thereof; the method comprising contacting a surface of the substrate with an aqueous gel composition of any one of embodiment 1 to 16 for a period of time sufficient to absorb the contaminating ions from the porous surface into the gel, and subsequently removing the gel from the surface.

Embodiment 18 comprises the method of embodiment 17 wherein the porous surface is contaminated with one or more radionuclide ions selected from the group consisting of americium, plutonium, uranium, curium, neptunium, strontium, radium, a lanthanide, and other fission product ions having a positive charge of 2 or greater.

Embodiment 19 comprises the method of any one of embodiments 17 to 18 wherein the porous surface is contaminated with one or more fission product ions having a positive charge of 1.

Embodiment 20 comprises the method of any one of embodiments 17 to 19 wherein the porous surface is contaminated with cesium ion.

DETAILED DESCRIPTION OF THE PREFERRED EMBODIMENTS

Figure 1:
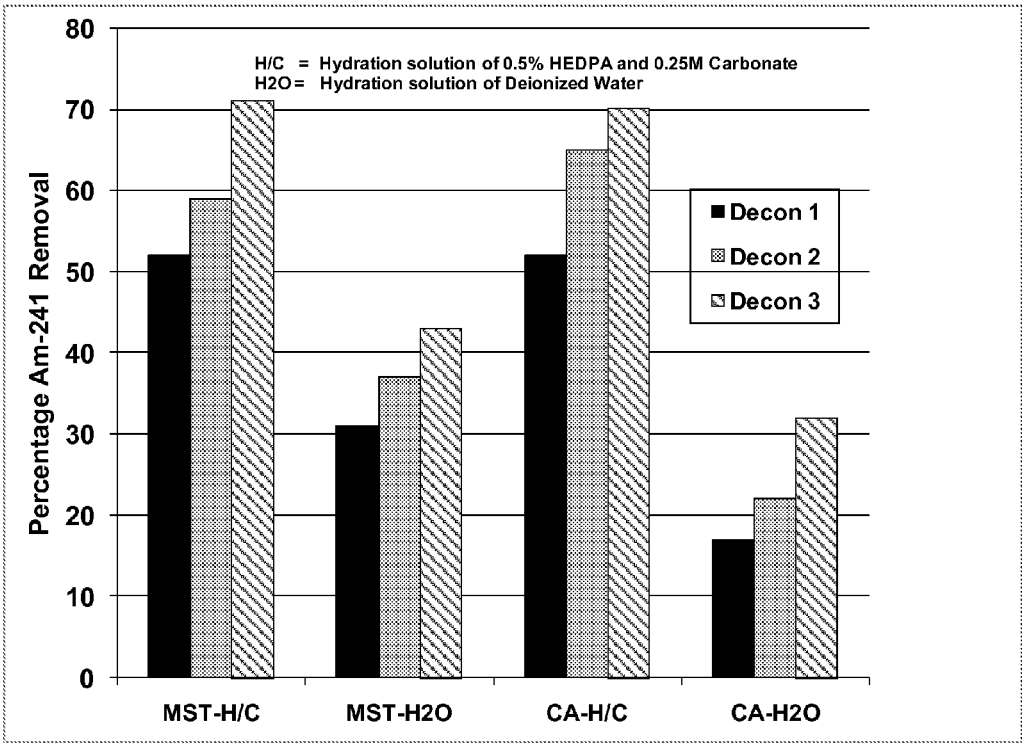
FIG. 1 provides a bar graph of Am-241 removal from concrete with gel compositions containing HEDPA, sodium carbonate, PAM/30% PAA copolymer (99:1 cross-linked to linear), and 10 wt % particulate monosodium titanate (MST) or cellulose acetate (CA) as a sequestrant, the wt % of the sequestrant being based on the combined dry weight of the polymers and sequestrant.

The present invention provides an aqueous gel composition for removing actinide ions, lanthanide ions, fission product ions and/or a combination thereof from a porous surface contaminated therewith. The composition comprises, consists essentially of, or consists of a polymer mixture comprising a gel forming cross-linked polymer and a linear polymer; wherein the linear polymer is present at a concentration that is less than the concentration of the cross-linked polymer; and the polymer mixture is at least about 95% hydrated with an aqueous solution to form a gel. The aqueous solution comprises about 0.01 to about 0.5 M of a multi-dentate organic acid chelating agent, and about 0.02 M to about 1 M carbonate salt. Optionally, the aqueous gel composition further includes at least one particulate sequestering agent dispersed in the aqueous gel.

The carbonate salt preferably comprises an alkali metal carbonate and/or bicarbonate (e.g., sodium carbonate, sodium bicarbonate, potassium carbonate, and/or potassium bicarbonate), ammonium carbonate and/or bicarbonate, or a combination thereof. The term "carbonate" is used herein for convenience to refer to fully ionized carbonate ion (i.e., $CO_3^{-2}$), bicarbonate ion (i.e., $HCO_3^{-1}$), and combinations thereof, since it is well known that carbonate and bicarbonate are in equilibrium in aqueous solution, the relative amount of the two species depending at least in part upon the pH of the aqueous solution. Preferably the carbonate is present at a molar concentration of about 0.2 to about 1 M (e.g., about 0.25 M, 0.3 M, 0.4 M or 0.5 M). Preferably, the hydrated gel composition has a pH that is chemically compatible with the cross-linked polymer (i.e., such that the hydrated polymer remains in a gel form during the decontamination process) and is suitable to maintain the carbonate ion in solution. Typically, the pH will be 7 or greater.

Multi-dentate chelating agents that can coordinate with metal ions having a +2, +3, or greater charge (i.e., as is the case for most actinides, lanthanides and other fission products) are well known in the art. Thus, the multi-dentate organic acid chelating agent component of the gel compositions described herein can be any organic material including two or more acid groups (preferably carboxylic acid groups, phosphonic acid groups, or a combination thereof), arrayed such that multiple acid groups on the chelating agent can coordinate with an actinide ion (e.g., an americium ion), a lanthanide ion, and/or a fission product ion (e.g., having an oxidation state of +2 or greater) in an aqueous environment. Multi-dentate organic acid chelating agents are well known in the art, and include, without limitation, 1-hydroxyethane-1,1-bisphosphonic acid (HEDPA), methane diphosphonic acid (MDPA), ethane-1,1-diphosphonic acid (EDPA), vinylidene-1,1-diphosphonic acid (VDPA), 1,2-dihydroxyethane-1,1-diphosphonic acid (DHEDPA), ethylenediaminetetraacetic acid (EDTA), propylenediaminetetraacetic acid (PDTA), diethylenetriaminepentaacetic acid (DTPA), 1,4,7,10-tetraazacyclododecane-1,4,7,10-tetraacetic acid (DOTA), ethylendiaminedisuccinic acid (EDDS), iminodisuccinic acid (IDS), and iminodiacetic acid (IDA), and salts (e.g., sodium salts) of any of the foregoing, for example. Preferred chelating agents for use in the compositions and methods of the present invention include HEDPA and EDTA. HEDPA is particularly preferred.

The chelating agent is included in the aqueous solution used to hydrate the polymers at a level in the range of about 0.01 to about 0.5 M. In some embodiments the chelating agent is present at a concentration of about 0.01 to about 0.25 M. In other embodiments, the chelating agent is present at a concentration in the range of about 0.02 M to 0.03M.

Cross-linked polymers for use in the compositions and methods described herein include any cross-linked anionic and/or nonionic polymer that is capable of forming a gel with water (e.g., deionized water) that includes the carbonate salt and chelator dissolved therein. Aqueous gel-forming anionic and nonionic polymers are well known in the polymer arts. Non-limiting examples of cross-linked anionic polymers include cross-linked homopolymers such as poly(acrylic acid) or poly(2-acrylamido-2-methylpropanesulfonic acid), as well as cross-linked copolymers of acrylamide and/or N-isopropylacrylamide with an acidic monomer such as acrylic acid, 2-acrylamido-2-methylpropanesulfonic acid. Non-limiting examples of cross-linked nonionic polymers include cross-linked polyacrylamide or cross-linked copolymers of acrylamide and one or more other nonionic monomer group (e.g., an acrylate ester, a substituted acrylamide, and the like). The principal purpose of the gel-forming polymer is believed to be to provide a viscous medium that will remain in place on the porous surface for a time sufficient to allow the chelated contaminant ions to diffuse out of the porous surface and into the gel without excessive flowing. Thus, the gel compositions can be utilized on vertical, as well as horizontal surfaces. Preferably, the gels have viscosity that is sufficient to prevent excessive flow, but not so high as to impede removal (e.g., by vacuuming the gel from the surface) of the gel from the surface, or to impede spraying the gel onto the surface to be decontaminated.

The linear ionic polymer component can be a non-cross-linked version of any of the foregoing cross-linked polymers. Combinations of two or more cross-linked polymers, two or more linear polymers, or both, can be utilized if desired.

While the polymers and chelators may be referred to herein for convenience as "acids", it is understood by those of ordinary skill in the chemical arts the actual ionic form of the polymers and chelators in the gel will depend, e.g., on the number of and type of ionizing groups that may be present in the materials, the concentration of the materials, the pH of the aqueous gel, and concentrations of the other components in the gel composition. Consequently, the term "acid" is used only for convenience and is meant to encompass both the acid form of the polymers and chelators, and the various ionized (salt) forms thereof (e.g., completely ionized and partially ionized salt form). Preferably the polymers and chelators are fully neutralized salts. Preferred salt forms of the polymers and chelators are alkali metal (e.g., sodium, potassium) and ammonium salts.

A preferred class of cross-linked and linear anionic polymers comprises copolymers of acrylamide and acrylic acid. Preferably, the acrylamide is the major monomer unit in the polymers. In one preferred embodiment, the cross-linked ionic polymer and/or the linear ionic polymer comprises a copolymer of acylamide and acrylic acid in a respective monomer molar ratio of about 70 to 30 (i.e., about 70% acrylamide monomer and 30% acrylic acid monomer, on a molar basis). The cross-linked polymers typically include a small percentage (typically <1%) of a cross-linking monomer (e.g., N,N'-methylene-bisacrylamide) incorporated in the polymers during the polymerization process, as is well known in the art. Gel-forming cross-linked anionic polymers and the non-cross-linked versions thereof are well known in the polymer arts.

The cross-linked polymer is present in the gel at a greater percentage concentration than the linear polymer, preferably in a weight ratio of cross-linked to linear polymer of greater than 80:20, more preferably greater than 90:10, even more preferably greater than 95:5. A particularly preferred ratio of cross-linked to linear polymer is about 99:1.

The cross-linked polymer in the polymer mixture forms a gel when hydrated. The approximate percentage of hydration of the polymer mixture is readily determinable by methods that are well known in the superabsorbing gel arts. For example, the amount of aqueous solution required to obtain full hydration of a given polymer mixture (i.e., "absorption capacity") can be determined by the well-known "tea bag" method, in which a known weight of dry polymer is placed in a pre-weighed, sealed water permeable bag or pouch (i.e., a "tea bag") and is steeped in the hydrating solution for a standard period of time sufficient for the cross-linked polymer to fully swell and hydrate. The tea bag containing the hydrate gel is removed and excess hydrating fluid is allowed to drain away. The total weight of the hydrated gel and bag, minus the known weights of the polymer and bag, is approximately equal to the weight of hydrating solution required to fully hydrate the gel, which can be normalized to a standard polymer weight (e.g., weight of solution required to fully hydrate gram of polymer mixture) if desired. A gel of a given percentage hydration can then be prepared by adding the appropriate amount of hydrating fluid to the dry polymer mixture needed to achieve the desired level of hydration. In the compositions and methods described herein, the polymers preferably are at least about 95% hydrated, more preferably fully hydrated.

The particulate sequestering agents used in the aqueous gel compositions and decontamination methods described herein can be any particulate material capable of coordinating and sequestering actinide ions, lanthanide ions and/or fission product ions (e.g., having a charge of +2 or greater). Preferably, the sequestering agent comprises at least one material selected from the group consisting of a clay (i.e., aluminosilicates, such as montmorillonite, bentonite, vermiculite, illite, kaolinite, attapulgite, halosite), a zeolite (natural and/or synthetic), a layered metal sulfide (e.g., $K_{2x}Mn_xSn_{3-x}S_6$, x=0.5 to 0.95, also known as KMS, a strontium selective sequestrant), monosodium titanate (MST), crystalline silicotitanate (CST), and cellulose acetate (CA), as well as materials such as Prussian Blue, clinoptilolite, mordenite, erionite, chabazite, niobates, pillared clays, and zeolites.

It has been observed that decontamination of actinides (e.g., americium) from concrete is very difficult. We have found that the cement component of the concrete is a major factor in depressing decontamination. Reactive groups in the cement apparently cause actinides such as americium to form low-solubility hydroxides, thus hampering removal of the actinide ions from the concrete. While not wishing to be bound by theory, inclusion of a carbonate salt in the aqueous gel composition as described herein is believed to promote actinide removal by converting such hydroxide materials in to more soluble carbonate forms.

The gel compositions described herein containing a PAM/30% PAA copolymer (99:1 cross-linked to linear polymer, sodium salts), sodium carbonate, and either HEDPA or EDTA have been shown to effectively remove americium ions from building materials such as tile and concrete contaminated with americium. In addition, the compositions described herein also can remove other fission ions, such as Cs-137 from building materials such as tile and concrete with high efficiency.

EXAMPLE 1

Americium Decontamination

Materials, Instruments, and Test Methods.

Several construction building materials were used in the evaluating the compositions and methods described herein: (1) fine aggregate, coarse aggregate, and broken coarse aggregate were used as received; (2) brick, concrete, and tile monoliths were cut into smaller coupon monoliths (about 1×1 in.); and (3) coarse, concrete aggregate, tile and brick samples were crushed, homogenized, and sieved to remove fines. Chemicals used to prepare ionic wash and/or gel hydrating solutions were ammonium chloride ($NH_4Cl$, Sigma-Aldrich, A.C.S. reagent, 99.5+%), potassium chloride (KCl, Malinkrodt, Analytical grade, 99.34%), 1-hydroxyethylidene-diphosphonic acid (HEDPA, Sigma-Aldrich), sodium carbonate ($Na_2CO_3$, Mallinckrodt), and ammonium phosphate monobasic ($NH_4H_2PO_4$, J.T. Baker). Ionic wash solutions were prepared from purified chemicals or commercially available cleaners and diluted by reverse-osmosis deionized water (RODI, 18 MΩ/cm$^2$) at the following concentrations: 1.0 M $NH_4Cl$, 1.0 M KCl, 1.0 M $NH_4H_2PO_4$, 10 wt % BARBASOL® shaving cream, 10 wt % BON-AMI® cleaner, 10 wt % DAWN® dishwashing soap, 10 wt % SIMPLE GREEN® cleaner, and 0.025 M HEDPA (0.5 wt %)/0.025 M $Na_2CO_3$. Radioactive wash solutions including Am-241 were prepared by adding a spike of a purified Am-241 stock solution to the desired wash solutions. The Am-241 stock solution was used as-received ($AmCl_3$ in 1M HCl, Isotope Products, 1 mCi/mL, carrier free).

The gel formulations used in the testing were prepared from an anionic polyacrylamide/polyacrylate (referred to as "PAM/30% PAA"). The anionic gel was prepared at a cross-linked-to-linear ratio of about 99/1. The anionic cross-linked polymer was a granular (<5 mm) poly(acrylamide) containing about 30 mol % acrylate to provide an anionic charge (Hydrosource Green Canteens, Castle International). The anionic linear polymer was poly(acrylamide) containing 30% acrylate to provide an anionic charge (Hydrosource Green Canteens, Castle International). Various sequestering agents were added to the gel as a dry powder during the gel preparation at 10 wt % and included crystalline silicotitanate (CST, IONSIV, Universal Oil Products), monosodium titanate (MST, 10 wt % suspension, Optima Chemical Group, LLC) and cellulose acetate (CA, Aldrich). "Tea bags" were constructed from Ahlstrom fabric.

Gel Hydration Capacity.

Tea bags were prepared with the desired polymer formulation and sequestering agent (i.e., 10 wt % of CST or cellulose acetate) sealed in the bags. The bags were heat sealed with a heat sealer and added to an excess of ionic wash solution to determine the hydration capacity. Once hydrated, the bags were removed, dried by blotting with a lint-free wipe, and then weighed. The resulting mass, adjusted for the known weights of the polymer, sequestering agent (if present), and bag, was considered to be the 100% hydration mass. The hydration capacity is the 100% hydration mass normalized to the weight of the polymer (and sequestering agent, if present).

Gamma-Ray Counting.

For gamma analysis, all monolithic samples were wrapped in plastic prior to movement and analyzed on an ORTEC high-purity germanium detector (HPGe). The Am-241 samples were placed against the detector face for counting. Each coupon was analyzed for at least 180 sec live-time. The region of interest encompassing the 59.5 keV photopeak of Am-241 was analyzed, and the net counts were used for data analysis.

Sample solutions were analyzed in a NaI gamma detector (MINAXI Gamma Counter 5000 Series, Perkin Elmer, Model A5550, 4π crystal), using the same regions of interest as stated above, and counted for at least 5 min.

Gel-Wash Solution Compatibility.

A small concrete sample was polished to 600 grit (P1200), and one-half of the sample was treated with 100 μL of 2 wt % HEDPA/0.25 M $Na_2CO_3$ and left to dry. Deionized water was used to lightly remove precipitated salt from the treated side. Additional concrete samples were examined by SEM after polishing the salt-covered surface briefly with 1 μm paste to clean the surface of salt but not physically remove concrete from the surface.

Sorption Kinetics of Americium Sequestering Agents.

The Am-241 stock solution was prepared by pipetting 2.8 mL of Am-241 stock into 25.2 mL of RODI water. The pH measured was 3.74. A 5 mL aliquot of this Am-241 stock solution was added to 50 mg of MST or CA powder (performed on four replicates of each sample). This slurry was mixed gently on a rotary shaker for 10 minutes (min) to 23 hours (h). A 100 μL aliquot was removed after mixing for gamma analysis at various times.

Crushed Concrete Decontamination.

Crushed concrete decontamination tests were run as follows. A 500 μL aliquot of Am-241 stock solution was added to contaminate about 0.5 g of crushed, homogenized concrete. The samples were equilibrated for about 60 min under periodic agitation. Then, the sample was centrifuged for several minutes, and an aliquot (20 μL) was withdrawn for counting. The remaining solution was removed and discarded. An aliquot of 500 μL water was added to the sample to rinse any entrained Am-241 from the sample, and the supernatant was removed as before and gamma counted. A 500 μL aliquot of decontamination wash solution was added to the sample and allowed to equilibrate for 60 min before centrifuging and withdrawing a 20 μL aliquot for gamma counting. The remaining supernatant was disposed. A second application of wash solution was made and sampled as above.

Two-Step Process—Concrete Monolith Decontamination.

The concrete coupons were placed into the climate control chamber (40° C. and 65% RH or 90% RH) and equilibrated overnight. A 100 μL aliquot of Am-241 stock was added to the "face" of the concrete coupons. The concrete was wrapped in plastic and counted on the HPGe gamma detector. The next day (24 hours), the first step of the decontamination process is the application of 100 μL of the wash solution to the contaminated face of the concrete. Before the wash solution dried (still wet after about 3 min), the second step of the process is to apply a portion of the gel composition to the face of the coupon. The coupons were returned to the climate control chamber. The gel was left in contact for 60 min. The gel was then vacuumed with the laboratory vacuum supply line. Using a lint-free wipe, we removed the remainder of the gel off the concrete. The concrete was once again counted on the gamma detector.

One Step Process—Concrete Monolith Decontamination.

Coupons were placed into the climate control chamber set at 40° C. and 90% relative humidity (RH) and equilibrated for one hour. A 100 μL aliquot of Am-241 stock solution was added to the "face" of the concrete and tile coupons. The coupons were wrapped in plastic and counted on the HPGe gamma detector. For the one-step decontamination process, only the gel reconstituted with the desired ionic wash solution is applied to the coupon for decontamination. The gel prepared for the testing was the PAM/30% PAA gel formulation (cross-linked:linear ratio of about 99:1) including 10 wt % MST or CA, and fully hydrated with the wash solution. A portion of gel was applied to the contaminated face. The coupons were returned to the climate control chamber set at 40° C. and 90% RH and equilibrated for one hour. The gel then was vacuumed off the coupon surface with the laboratory vacuum supply line, and the remainder of the gel was removed from the coupon with a lint-free wipe. The coupon was once again counted on the gamma detector.

Tile Decontamination—Two-Step Process.

Tile monoliths were evaluated for Am-241 decontamination using the same two-step method described for the concrete monoliths. The contaminant was aged for 2 hr. Then, the two-step method was performed with 1 wt % HEDPA/0.25 M $Na_2CO_3$ wash solution. The gel formulation used in the testing was the anionic PAM/30% PAA (cross-linked:linear ratio of 99:1) with 10 wt % CST. The gel was hydrated to 100% capacity with an ionic wash solution of 1 wt % HEDPA/0.25 M $Na_2CO_3$.

Long-Term Tile Decontamination.

The decontamination of tile aged for 7 days with Am-241 was evaluated using the one-step decontamination process. The gel formulation used in the testing was PAM/30% PAA (cross-linked:linear ratio of 99:1) with 10 wt % CST or 10 wt % cellulose acetate at 100% hydration capacity with an ionic wash solution of 1 wt % HEDPA/0.25 M $Na_2CO_3$ or RODI water. The tiles were placed in the climate control chamber (40° C. and 90% RH) and equilibrated for at least one hour. A 100 μL aliquot of Am-241 stock was added to the face of the tiles. When the Am-241 dried (about an hour), the coupons were enclosed in plastic wrap, and the Am-241 was counted by gamma analysis. The coupons were returned to the climate control chamber for seven days. After seven days, the gel was applied to the contaminated face, and coupons were returned to the climate control chamber. The gel was left in contact for 60 min. The gel was then vacuumed with a vacuum pump, and then a lint-free wipe was used to remove any remaining residue from the concrete. The concrete was once again counted on the gamma detector. For subsequent decontaminations (decontamination #2 and decontamination #3) the gel was left in contact for 60 min and then vacuumed and wiped as before and counted by gamma analysis.

For gamma analysis, the samples were wrapped in plastic and analyzed on the HPGe gamma detector. The samples were counted with the contaminated face of the tile placed directly on the detector face. Each tile sample was analyzed for 180 sec live-time. The region of interest encompassing the Am-241 peak at 59.5 keV was analyzed, and the net counts were used for data analysis.

Results.

Wash Solution Compatibility with Polymer and Concrete.

The absorption capacities of the 99:1 cross-linked-to-linear PAM/30% PAA copolymer were evaluated in HEDPA-containing solutions (Table 1). No significant difference in the polymer adsorption capacity was found between 0.5 wt % HEDPA (0.025M) and 0.1 wt % HEDPA (0.005 M) formulations (22.1±0.1 and 22.9±0.1 g/g, respectively). Additional hydration testing of the polymer with and without 10% by mass of cellulose acetate added was performed using 0.5 wt % HEDPA/0.025 M $Na_2CO_3$ as the hydration solution. The effect of the lower salt concentration was evidenced in the capacity results. The mean capacities were 43.8±0.3 g/g with 10 wt % cellulose acetate and 47.3±0.4 g/g without cellulose acetate.

TABLE 1

| Wash solution | Initial mass (g) | T-bag (g) | After soak - Final mass (g) Multiple measurements 1 | 2 | 3 | Mean capacity, g/g | Standard deviation |
|---|---|---|---|---|---|---|---|
| Blank | 0.1638 | 0.1638 | 0.5423 | 0.4954 | 0.4808 | 0.3397 | |
| | 0.1642 | 0.1642 | 0.5367 | 0.4888 | 0.4765 | | |
| | 0.1639 | 0.1639 | 0.5394 | 0.4903 | 0.4828 | | |
| 0.5% | 0.7163 | 0.1640 | 13.3207 | 13.2915 | 13.2808 | 22.06 | 0.1073 |
| HEDPA/ | 0.7176 | 0.1642 | 13.2859 | 13.2701 | 13.2596 | | |
| 0.25M | 0.7162 | 0.1650 | 13.1688 | 13.1517 | 13.1452 | | |
| $Na_2CO_3$ | | | | | | | |
| 0.1% | 0.7166 | 0.1640 | 13.8214 | 13.7943 | 13.7697 | 22.92 | 0.1158 |
| HEDPA/ | 0.7186 | 0.1641 | 13.7480 | 13.7197 | 13.6984 | | |
| 0.25M | 0.7159 | 0.1641 | 13.6987 | 13.6723 | 13.6539 | | |
| $Na_2CO_3$ | | | | | | | |
| 0.5% | 1.1003 | 1.0735 | 50.2460 | Note: with | | 43.8 | 0.3 |
| HEDPA/ | 1.1009 | 1.0735 | 50.739 | cellulose | | | |
| 0.025M | 1.1006 | 1.0735 | 50.0894 | acetate | | | |
| $Na_2CO_3$ | | | | | | | |
| 0.5% | 1.0004 | 1.0735 | 49.7323 | | | 47.3 | 0.4 |
| HEDPA/ | 1.0013 | 1.0735 | 49.6336 | | | | |
| 0.025M | 1.0012 | 1.0735 | 48.9388 | | | | |
| $Na_2CO_3$ | | | | | | | |

The chemical compatibility of the HEDPA/carbonate solution with the concrete surface was examined to evaluate the effect of the solution on the integrity of the concrete. A 2 wt % HEDPA/0.25 M $Na_2CO_3$ solution was applied to a polished concrete surface. Deionized water was used to lightly remove precipitated salt from the treated side, and the surface was examined by SEM. The micrographs did not reveal any chemical etching on the concrete surface.

Additional testing of the compatibility of the HEDPA/carbonate solution with the gel-forming polymer was performed to determine the hydration capacity of the gel and its consistency for application purposes. Previous tests with strong acid, HCl, showed that the gel-forming polymer degraded into a watery mass, likely due to rapid hydrolysis of the polymeric chains. The gel formulation hydrated with the HEDPA/carbonate solution did not appear to chemically degrade, and the absorption capacity was similar to KCl-containing formulations developed for decontamination of Cs-137.

While the SEM analyses of the concrete in contact with the HEDPA/carbonate solution did not find evidence of degradation of the surface (e.g., pitting, etching, delamination), the results were somewhat obscured because of heavy carbonate salt precipitation onto the surface. The surface of the concrete sample was examined again after polishing the salt-covered surface briefly with 1 μm paste to clean the surface of salt, but not physically remove concrete from the surface. This second examination also failed to find any evidence of surface degradation due to the HEDPA/carbonate solution.

A slimy adherent gel layer was observed on the concrete surfaces after the testing with 0.5 wt % HEDPA/0.25 M $Na_2CO_3$. It was suspected that this effect may be due to acid hydrolysis of the polymeric network and might be mitigated by a reduction in the HEDPA concentration. To test this hypothesis, the HEDPA concentration was reduced from 0.5 wt % to 0.1 wt % and repeated the test for the decontamination of concrete. No slimy adherent layer was observed in that test. Based on the known properties of HEDPA and the gels, it is believed that the use of the sodium or potassium salt form of HEDPA might mitigate the occurrence of the slimy layer, such that higher concentrations or HEDPA (e.g., higher than 0.1 to 0.5 wt %) can be used without forming the slimy layer.

Crushed Concrete Decontamination.

Previous attempts to decontaminate americium from crushed concrete samples with wash solutions was unsuccessful in finding a wash solution composition to desorb americium from the constituents of the concrete. Some very powerful chelating agents and aggressive acids failed to produce a measurable desorption of americium from concrete. It was hypothesized that the americium was precipitating in the concrete as an insoluble hydroxide, and that conversion of the americium to the carbonate form would produce a mobile species that could then be complexed to remove it from the concrete. Indeed, that was the case. The following wash formulations were tested based upon this hypothesis: (1) a solution of carbonate and a common chelator, ethylenediaminetetraacetic acid (EDTA), (2) a solution of carbonate and EDTA at a higher concentration of carbonate, (3) a solution of carbonate and HEDPA, a powerful chelating agent for multivalent species (HEDPA, by itself, was used in previously unsuccessful tests), and (4) a carbonate control solution. The combination of the carbonate solution with HEDPA was able to remove 80% of the Am-241. However, solutions of the individual chemical components or the combination of the carbonate with EDTA were ineffective in removing Am from the concrete (<1% for initial decontamination): i.e., carbonate alone, HEDPA alone, and EDTA alone.

Sequestering Agents for Americium.

The kinetics for the sorption of americium onto MST and cellulose acetate were studied over a 24-hour period. MST is a preferred sequestering agent for americium, which has been extensively studied in the past by nuclear waste experts in the U.S. and abroad and is ideally suited for this technology. The cellulose acetate produced relatively poor partitioning coefficients ($K_d$<25 mL/g) for the entire time period. The MST exhibited good $K_d$ values (>600 mL/g) even for short contact times (<1 hour) and showed an increase in $K_d$ to >1000 mL/g for long contact times of about 1 day. The relative standard deviation on four replicates for MST tests was about 2 to 7% and 11-23% for cellulose acetate.

Two-Step Process—Concrete Monolith Decontamination.

Based upon the earlier success in the decontamination of americium from crushed concrete, the HEDPA/$Na_2CO_3$ wash solution was evaluated for the decontamination of concrete monoliths. The two-step decontamination process was initiated within several hours of the Am-241 contamination of the concrete, and testing was performed at 40° C. and 65% RH. First, the wash solution of 1 wt % HEDPA/0.25 M $Na_2CO_3$ was applied to the concrete, and then the gel was applied. The gel formulation was the anionic PAM/30% PAA (cross-linked:linear ratio of 99:1) with 10 wt % CST; the gel was hydrated to 95% capacity with the same wash solution, 1 wt % HEDPA/0.25 M $Na_2CO_3$.

The americium decontamination results were much lower than expected based on the tests with the crushed concrete. The initial decontamination for the monoliths resulted in only 34% removal of americium compared to 55% for the crushed concrete tests. However, the wash solution for the decontamination of the crushed concrete was performed at a higher concentration of HEDPA (2 wt % HEDPA/0.25 M $Na_2CO_3$).

This test was followed by another test at 100% hydration capacity of the gel. Concrete monoliths aged for only about 2 hours with americium were evaluated for decontamination using the two-step process with 1 wt % HEDPA/$Na_2CO_3$ wash solution. Initial decontamination of americium from the concrete samples was 35±14%. An additional decontamination from the same coupons using fresh hydrated gel resulted in a total americium decontamination of 52.4±22.0%.

One-Step Method—Concrete Monolith Decontamination.

The one-step decontamination method was used for additional monolith testing. Since a high level of HEDPA appeared to be degrading the polymer in the gel, the HEDPA concentration in the gel formulation was decreased, and the decontamination of americium from concrete was evaluated with the modified formulation. The one-step method was employed for americium aged 72 hours prior to the first decontamination. Test results are the average of five replicates. In these tests, the HEDPA concentration in the gel formulation was 0.5 or 0.1 wt %, yet the recovery of americium was 69 and 31% for the 0.5 and 0.1 wt % HEDPA gel formulations, respectively. These results show that the one-step process combined with the reduction in HEDPA concentration improved the removal of americium by a factor of two (69% for 0.5 wt % HEDPA compared to 35% for 1 wt % HEDPA for the first decontamination). A comparable decontamination of americium from concrete was obtained for the 0.1 wt % HEDPA formulation (31%) when compared with the 1 wt % HEDPA two-step decontamination process (35%).

Gel Sequestering Agents for Americium.

Two sequestering agents, MST and cellulose acetate, were incorporated into the gel formulation for the decontamination of concrete monolith samples aged 72 hours. The one-step method was used with anionic PAM/30% PAA (cross-linked: linear ratio of 99:1) with 10 wt % MST or 10 wt % cellulose acetate. The gel was hydrated to 100% capacity with an ionic wash solution of 0.5 wt % HEDPA/0.25 M $Na_2CO_3$ or RODI water. Upon decontamination, the hydrogel left a slimy film, which dried to a whitish color. The results highlight the dramatic improvement in americium decontamination obtained with the gel prepared with HEDPA/carbonate over deionized water for both the MST and CA agents (FIG. 1). Moreover, the inclusion of MST or CA produced similar removal results to that reported for HEDPA/carbonate without the inclusion of a solid sequestering agent. Thus, the benefit of the solid sequestering agent is believed to result from dehydration of the polymer and/or gel and interruption of the gel structure, such that the chelated radionuclides are made available to the sequestering agent for chelation or complexation therewith. By this action, the sequestering agent improves the stability of the final gelled material (i.e., containing the radionuclides) being sent for disposal.

Tile Decontamination—Two Step Method.

Tile monoliths were evaluated for Am-241 decontamination of same-day contaminant (aged for 2 hours) using the two-step method with 1 wt % HEDPA/$Na_2CO_3$ wash solution. Initial decontamination of americium from the tile samples was 98.7±0.3%. An additional decontamination from the same coupons using fresh gel resulted in a total americium decontamination of 99.6±0.2% for the tile.

Long-Term Tile Decontamination

Figure 2:
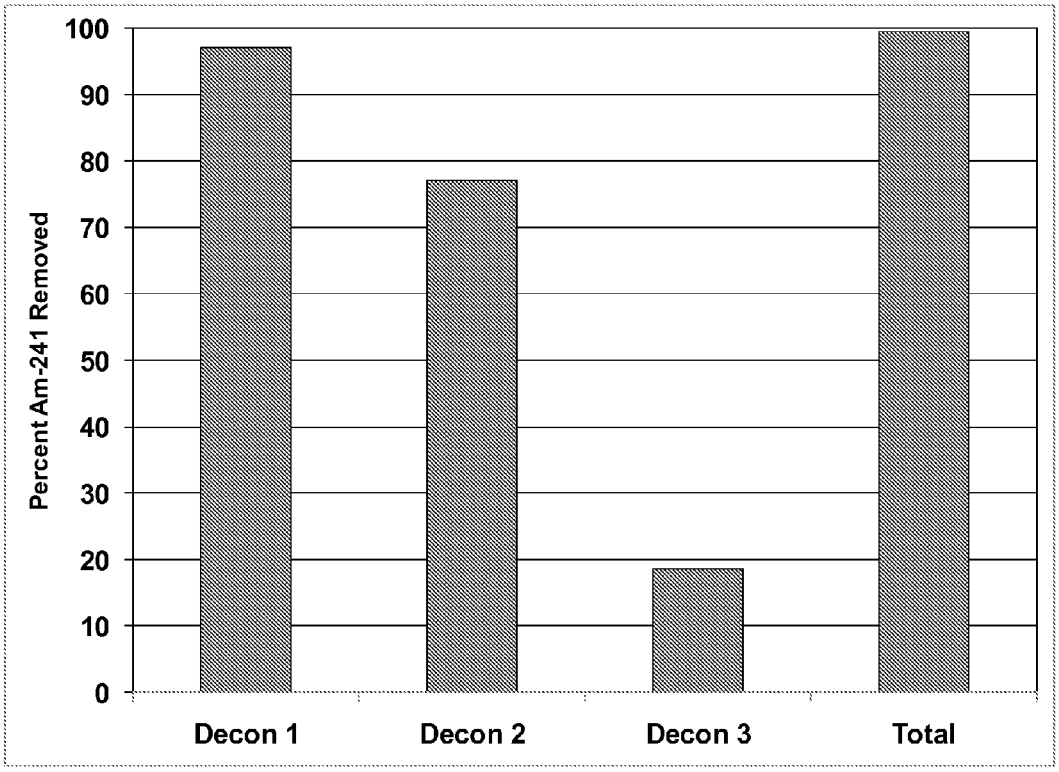
FIG. 2 provides a bar graph of successive removal of Am-241 from tile with gel compositions containing HEDPA, sodium carbonate, PAM/30% PAA copolymer (99:1 cross-linked to linear), and 10 wt % crystalline silicotitanate (CST), the wt % of CST being based on the combined dry weight of the polymers and CST.

The decontamination of americium from tile monoliths contaminated and aged 7 days was completed with the one-step method for two gel formulations. The first test used the anionic PAM/30% PAA (cross-linked:linear ratio of 99:1) with 10 wt % CST hydrated to 100% capacity with 1 wt % HEDPA/0.25 M $NaCO_3$. Test results are the average of five replicates. Results showed the ease of decontaminating americium from tile even after seven days. Initial decontamination of americium from the tile monoliths was 97% (FIG. 2). Successive decontaminations from the same coupons using fresh gel resulted in a total americium decontamination of 99.5% (FIG. 2). This result was comparable to americium tile decontamination by two-step method using the same gel formulation and a contamination aging of only several hours.

Figure 3:
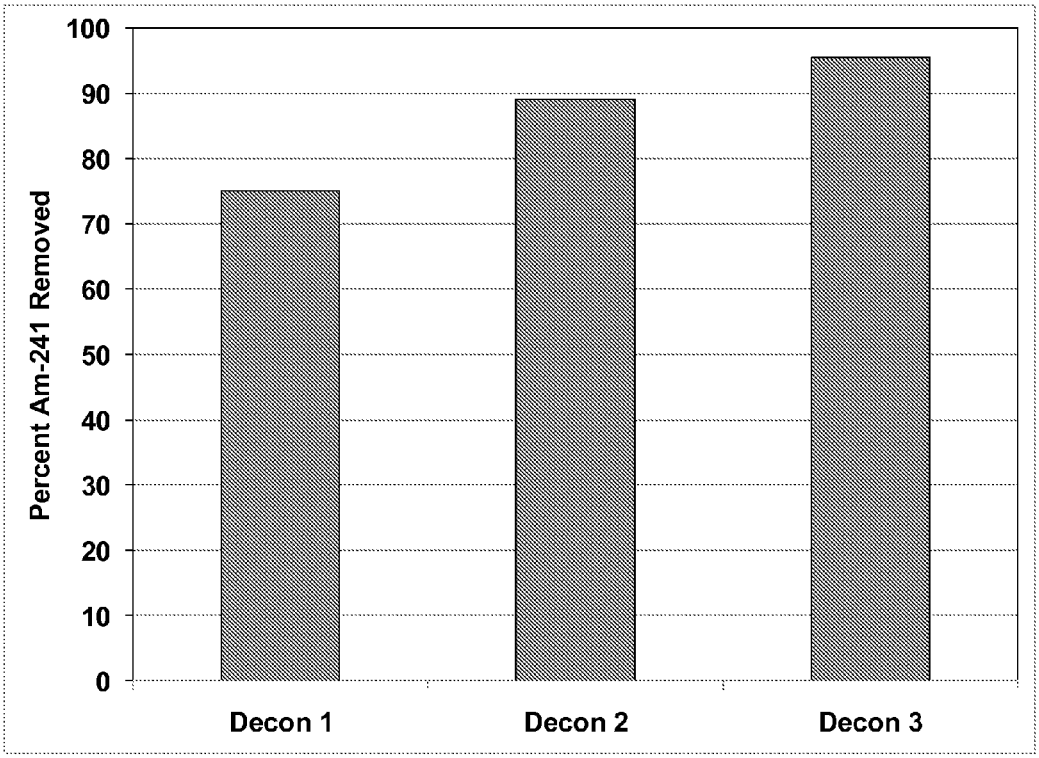
FIG. 3 provides a bar graph of successive removal of Am-241 from tile with gel compositions containing deionized water, PAM/30% PAA copolymer (99:1 cross-linked to linear), and 10 wt % CST, the wt % of CST being based on the combined dry weight of the polymers and CST.

The second gel formulation used for decontamination of americium was a control prepared with deionized water and cellulose acetate as the sequestering agent. This gel formulation was the anionic PAM/30% PAA (cross-linked:linear ratio of 99:1) with 10 wt % cellulose acetate and was hydrated to 100% capacity with deionized water. Initial decontamination of americium from the tile monoliths was 75% (FIG. 3). Successive decontaminations from the same coupons using fresh gel resulted in a total americium decontamination of 95% (FIG. 3). The initial americium removal was much poorer for the gel prepared with water than when the gel was reconstituted with HEDPA/carbonate (compared with FIG. 2 where the initial decontamination was 97%).

EXAMPLE 2

Americium and Cesium Decontamination

Testing of a gel composition as described herein was performed on concrete coupons to evaluate the effectiveness for decontamination of various concentration levels of Cs and Am. Gel formulations comprising PAM/30% PAA gel (cross-linked:linear ratio of 99:1) were prepared at 100% hydration with either 0.5 M aqueous potassium carbonate (comparative formulation) or an aqueous solution comprising 0.025 M HEDPA (i.e., 0.5 wt % HEDPA) and 0.5 M potassium carbonate. The gels were evaluated for their effectiveness at removal of cesium and americium ion from contaminated concrete coupons. Tests were run in triplicate with each gel formulation using Singaporean concrete coupons. All sides of the coupons except the face were sealed with 5-minute epoxy (DEVCON 5-min epoxy #14270) for decontamination experiments. The faces of the coupons were contaminated either with 100 μL of Cs-137 spiked stock solutions (prepared at low, medium and high concentration with non-radioactive cesium as appropriate) or with 100 μL of an Am-241 stock solution (only one concentration, since non-radioactive Am is unavailable). Coupons were allowed to dry and then bagged into individual sealable bags for counting on a high purity germanium detector (Detector 1, EG&G ORTEC HPGe, position 20 cm, 600 second live time). Samples were aged for one week at room temperature, and then approximately 3 grams of gel was applied to the contaminated coupon face and left in contact with the contaminated coupon surface for about 60 minutes. The gel was removed from the coupon, and the coupons were allowed to dry before bagging and analyzing by gamma spectrometry (under same counting conditions as the contamination coupons).

The results of cesium and americium removal are shown in Table 2 (Cs) and Table 3 (Am). The results for cesium decontamination are consistent with previous testing that shows approximately 70% removal of cesium in a single decontamination application. Importantly, the decontamination results for americium are much improved with this formulation relative to the formulation with only 0.25 M carbonate (e.g., as in Example 1). In particular, a 73% Am decontamination was observed for the 0.5 M potassium carbonate/0.025M HEDPA gel of this Example relative to only about 50% decontamination of Am from concrete with the 0.25 M sodium carbonate/0.025 M HEDPA gel of Example 1.

TABLE 2

Removal of cesium (Cs) ion at low, medium and high contaminant concentrations from concrete.

| Coupon | Gel Wash Solution | Mass of Gel (g) | Cs Removal (%) | Average Removal (%) | Std Dev Removal (%) |
|---|---|---|---|---|---|
| low Cs | | | | | |
| 1 | 0.5M | 3.1 | 77.0 | 78.7 | 8.9 |
| 2 | $K_2CO_3$ | 3.4 | 70.8 | | |
| 3 | | 2.6 | 88.4 | | |
| 4 | 0.5M $K_2CO_3$/ | 3.3 | 77.2 | 64.5 | 11.0 |
| 5 | 0.025M | 3.3 | 58.7 | | |
| 6 | HEDPA | 3.0 | 57.8 | | |
| medium Cs | | | | | |
| 7 | 0.5M | 3.0 | 79.0 | 76.1 | 7.3 |
| 8 | $K_2CO_3$ | 2.9 | 67.9 | | |
| 9 | | 2.8 | 81.6 | | |
| 10 | 0.5M $K_2CO_3$/ | 3.4 | 47.3 | 60.8 | 12.2 |
| 11 | 0.025M | 3.6 | 64.4 | | |
| 12 | HEDPA | 3.4 | 70.8 | | |
| high Cs | | | | | |
| 13 | 0.5M $K_2CO_3$/ | 3.8 | 75.0 | 61.0 | 12.2 |
| 14 | 0.025M | 3.4 | 53.8 | | |
| 15 | HEDPA | 4.0 | 54.3 | | |

TABLE 3

Removal of americium ion from concrete.

| Coupon ID | Gel Wash Solution | Mass of Gel (g) | Am Removal (%) | Average Removal (%) | Std Dev Removal (%) |
|---|---|---|---|---|---|
| 16 | 0.5M | 2.6 | 15.7 | 18.6 | 2.9 |
| 17 | $K_2CO_3$ | 2.2 | 18.5 | | |
| 18 | | 2.5 | 21.5 | | |
| 19 | 0.5M $K_2CO_3$/ | 3.3 | 66.7 | 73.0 | 5.8 |
| 20 | 0.025M | 3.4 | 78.1 | | |
| 21 | HEDPA | 3.1 | 74.3 | | |

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All numerical values obtained by measurement (e.g., weight, concentration, physical dimensions, removal rates, flow rates, and the like) are not to be construed as absolutely precise numbers, and should be considered to encompass values within the known limits of the measurement techniques commonly used in the art, regardless of whether or not the term "about" is explicitly stated. All methods described herein can be performed in any suitable order unless otherwise indicated herein or otherwise clearly contradicted by context. The use of any and all examples, or exemplary language (e.g., "such as") provided herein, is intended merely to better illuminate certain aspects of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Specific embodiments of the invention in which an exclusive property or privilege is claimed are defined as follows:

1. An aqueous gel composition for removing actinide ions, lanthanide ions, fission product ions, or a combination thereof from a porous surface contaminated therewith; the composition comprising a polymer mixture comprising a gel-forming cross-linked polymer and a linear polymer; wherein the linear polymer is present at a concentration that is less than the concentration of the cross-linked polymer; the polymers are anionic, nonionic or a combination thereof, and the polymer mixture is at least about 95% hydrated with an aqueous solution to form a gel; the aqueous solution comprises a molar (M) concentration of about 0.01 M to about 0.5 M of a multi-dentate organic acid chelating agent, and about 0.02 to about 1 M carbonate salt; and the polymer mixture optionally includes at least one particulate sequestering agent.

2. The aqueous gel composition of claim 1 wherein the carbonate salt is present at a concentration in the range of about 0.25 M to 0.5 M.

3. The aqueous gel composition of claim 1 wherein the cross-linked polymer and the linear polymer are present in a respective weight ratio of about 99 to 1.

4. The aqueous gel composition of claim 1 wherein the polymers are present in the gel at a combined concentration in the range of about 2 to about 6 percent by weight (wt%).

5. The aqueous gel composition of to claim 1 wherein the cross-linked polymer comprises a copolymer of acrylamide and acrylic acid.

6. The aqueous gel composition of any claim 1 wherein the linear polymer comprises a copolymer of acrylamide and acrylic acid.

7. The aqueous gel composition of claim 1 wherein each of the cross-linked polymer and the linear polymer comprises a copolymer of acrylamide and acrylic acid in a relative monomer molar ratio of about 70 to 30.

8. The aqueous gel composition of any one of claim 1 wherein the multi-dentate organic acid chelating agent comprises at least one material selected from the group consisting of 1-hydroxyethane-1,1-bisphosphonic acid (HEDPA) and ethylenediaminetetraacetic acid (EDTA).

9. The aqueous gel composition of claim 8 wherein the HEDPA is present at a concentration of about 0.02 to 0.03 M.

10. The aqueous gel composition of claim 1 wherein the carbonate salt comprises an alkali metal carbonate, an alkali metal bicarbonate, ammonium carbonate, ammonium bicarbonate, or a combination of two or more thereof.

11. The aqueous gel composition of claim 1 wherein the polymer mixture comprises at least one particulate sequestering agent.

12. The aqueous gel composition of claim 11 wherein the sequestering agent is selected from the group consisting of a clay, a zeolite, a layered metal sulfide, crystalline silicotitanate (CST), monosodium titanate (MST), cellulose acetate (CA), and a combination of two or more thereof.

13. The aqueous gel composition of claim 12 wherein the at least one particulate sequestering agent is present in the polymer mixture at a concentration in the range of about 5 to about 15 wt% based on the combined dry weight of the polymers and the sequestering agent.

14. The aqueous gel composition of claim 1 wherein the composition comprises about 2 to about 6 percent by weight (wt %) of the polymer mixture comprising the gel forming cross-linked anionic polymer salt and the linear anionic polymer salt; wherein the linear anionic polymer salt is present at a concentration that is less than the concentration of the cross-linked anionic polymer salt; each of the cross-linked anionic polymer salt and the linear anionic polymer salt comprises a copolymer of acrylamide and acrylic acid in a relative monomer molar ratio of about 70 to 30; the cross-linked anionic polymer salt is at least about 95% hydrated with an aqueous solution to form a gel; the aqueous solution comprises about 0.01 M to about 0.25 M of a multi-dentate organic acid chelating agent, and about 0.25 to about 0.5 M carbonate salt; and the multi-dentate organic acid chelating agent comprises at least one material selected from the group consisting of 1-hydroxyethane-1,1-bisphosphonic acid (HEDPA), ethylenediaminetetraacetic acid (EDTA), and a salt thereof.

15. The aqueous gel composition of claim 14 wherein the polymer mixture further comprises about 5 to about 15 wt % of at least one particulate sequestering agent based on the combined dry weight of the polymers and the sequestering agent.

16. The aqueous gel composition of claim 15 wherein the sequestering agent is selected from the group consisting of a clay, a zeolite, a layered metal sulfide, crystalline silicotitanate (CST), monosodium titanate (MST), cellulose acetate (CA), and a combination of two or more thereof.

17. A method of decontaminating a porous surface contaminated with actinide ions, lanthanide ions, fission product ions, or a combination thereof; the method comprising contacting a surface of the substrate with an aqueous gel composition of claim 1 for a period of time sufficient to absorb the contaminating ions from the porous surface into the gel, and subsequently removing the gel from the surface.

18. The method of claim 17 wherein the porous surface is contaminated with one or more radionuclide ions selected from the group consisting of americium, plutonium, uranium, curium, neptunium, strontium, radium, a lanthanide, and other fission product ions having a positive charge of 2 or greater.

19. The method of claim 17 wherein the porous surface is contaminated with one or more fission product ions having a positive charge of 1.

20. The method of claim 17 wherein the porous surface is contaminated with cesium ion.

* * * * *